US009937558B2

(12) United States Patent
Ohmori et al.

(10) Patent No.: US 9,937,558 B2
(45) Date of Patent: Apr. 10, 2018

(54) FE-BASED SINTERED ALLOY AND MANUFACTURING METHOD THEREOF

(71) Applicant: HITACHI CHEMICAL COMPANY, LTD., Tokyo (JP)

(72) Inventors: Hiroshi Ohmori, Matsudo (JP); Yuji Yamanishi, Matsudo (JP)

(73) Assignee: HITACHI CHEMICAL COMPANY, LTD., Tokyo (JP)

( * ) Notice: Subject to any disclaimer, the term of this patent is extended or adjusted under 35 U.S.C. 154(b) by 818 days.

(21) Appl. No.: 14/192,247

(22) Filed: Feb. 27, 2014

(65) Prior Publication Data

US 2014/0286811 A1 Sep. 25, 2014

(30) Foreign Application Priority Data

Mar. 25, 2013 (JP) ..... 2013-061996

(51) Int. Cl.

| | |
|---|---|
| ***C22C 33/02*** | (2006.01) |
| ***B22F 3/12*** | (2006.01) |
| ***C22C 38/02*** | (2006.01) |
| ***C22C 38/04*** | (2006.01) |

(52) U.S. Cl.

CPC ..... *B22F 3/12* (2013.01); *C22C 33/0207* (2013.01); *C22C 38/02* (2013.01); *C22C 38/04* (2013.01); *B22F 2998/10* (2013.01)

(58) Field of Classification Search

CPC .... B22F 3/12; B22F 2998/10; C22C 33/0207; C22C 38/00; C22C 38/002; C22C 38/004; C22C 38/04; C22C 38/02

See application file for complete search history.

(56) References Cited

U.S. PATENT DOCUMENTS

| | | | | |
|---|---|---|---|---|
| 5,049,183 | A | 9/1991 | Saka et al. | |
| 6,110,419 | A * | 8/2000 | Buckley-Golder .... | B21H 5/022 419/28 |
| 2003/0039572 | A1* | 2/2003 | Kosco ..... | B22F 3/105 419/28 |
| 2008/0025866 | A1 | 1/2008 | Kondoh et al. | |
| 2008/0233421 | A1 | 9/2008 | Tanino et al. | |
| 2010/0116088 | A1* | 5/2010 | Sato ..... | C22C 38/04 75/243 |

FOREIGN PATENT DOCUMENTS

| | | |
|---|---|---|
| CN | 1946865 A | 4/2007 |
| DE | 4 031 408 A1 | 4/1991 |
| DE | 101 20 724 A1 | 12/2001 |
| GB | 2 237 029 A | 4/1991 |
| JP | B2-2648519 | 9/1997 |

OTHER PUBLICATIONS

Zhang et al., "Fe—Mn—Si master alloy steel by powder metallurgy processing," J. of Alloys and Compounds, 363 (2004), pp. 194-202.*

May 20, 2016 Office Action issued in Chinese Patent Application No. 201410165335.9.

Oct. 8, 2015 Office Action issued in German Patent Application No. 102014004313.4.

* cited by examiner

*Primary Examiner* — Keith Walker
*Assistant Examiner* — John A Hevey
(74) *Attorney, Agent, or Firm* — Oliff PLC

(57) ABSTRACT

An Fe-based sintered alloy, essentially consists of, in percentage by mass, Mn: 0.5 to 2.0, Mo: 0.3 to 1.6, Cu: 0.4 to 1.5, C: 0.4 to 0.7 and the balance of Fe plus unavoidable impurities; and has a metallic structure made of 5 to 70% of martensite phase relative to a base material except pore and 25 to 90% of bainite phase relative to the base material except the pore.

6 Claims, No Drawings

FE-BASED SINTERED ALLOY AND MANUFACTURING METHOD THEREOF

CROSS-REFERENCE TO RELATED APPLICATIONS

This application is based upon and claims the benefit of priority from the prior Japanese Patent Application No. 2013-061995 filed on Mar. 25, 2013; the entire contents which are incorporated herein by reference.

BACKGROUND

1. Field of the Invention

The present invention relates to an Fe-based sintered alloy which is obtained by sintering a green compact which is obtained by compressing and compacting a raw powder material containing iron as main component in a die and a manufacturing method thereof. Particularly, the present invention relates to an Fe-based sintered body having high mechanical strength and toughness in the state of sintering body after sintering and the manufacturing method thereof.

2. Background of the Invention

In powder metallurgy process where a raw powder material is compressed and compacted in a die and the thus obtained green compact is sintered, since the intended component can be formed in the state of near net shape, the powder metallurgy process can be characterized by the low material loss due to small machining allowance in post-mechanical process, the mass production of the same shape component once a prescribed die is formed, and the manufacture of special alloy which cannot be obtained by means of normal melting and casting method, thereby developing the cost performance in the formation of the intended component. In this point of view, the powder metallurgy process is widely employed for vehicle component.

For example, a synchronizer hub to be used in a transmission of a vehicle is required to have high mechanical strength and toughness because the synchronizer hub is driven under bending stress and tensile stress due to the sliding against an input shaft, an output shaft, a sleeve and a ring while the synchronizer hub is subject to the impact when the synchronizer hub is geared with an opponent component by shifting operation. In such a synchronizer hub as described above, the powder metallurgy process is being available as disclosed in Patent document No. 1.

The sintered alloy disclosed in Patent document No. 1 consists of, in percentage by mass, Ni: 2 to 6, Cu: 1 to 3, Mo: 0.6 to 1.6, C: 0.1 to 0.8 and the balance of Fe, and is made of the raw powder material of the mixture of partial diffusion alloy powder consisting of, in percentage by mass, 2 to 6, Cu: 1 to 3, Mo: 0.4 to 0.6 and the balance of Fe, 0.1 to 0.8 mass % of graphite powder and 0.2 to 1 mass % of molybdenum. In the sintered alloy disclosed in Patent document No. 1, nickel is contributes to the hardenability of the base material of the sintered alloy with molybdenum and copper so as to form hard phase such as martensite and bainite and to form austenitic phase containing rich nickel, thereby having both of mechanical strength and toughness.

Patent document No. 1: Japanese Patent publication No. 2648519

BRIEF SUMMARY OF THE INVENTION

In order to cope with the recent trend of cost reduction, however, it is required for the sintered alloy to decrease cost. In contrast, since such metal as nickel is too expensive, cost reduction of an Fe-based sintered alloy is required in substitution for the sintered alloy containing nickel as essential component disclosed in Patent document No. 1. In this point of view, it is an object of the present invention to provide a low cost Fe-based sintered alloy having high mechanical strength and toughness and the manufacturing method of the Fe-based sintered alloy.

In order to solve out the aforementioned problem, the first gist of a sintered alloy according to the present invention is to use molybdenum and manganese in substation for nickel as alloy element so as to improve hardenability. The second gist of a sintered alloy according to the present invention is to have both of high mechanical strength and toughness by rendering the metallic structure of the sintered alloy in the state of the mixture of martensite and bainite, the martensite being excellent in mechanical strength and poor in toughness, and the bainite being poorer in mechanical strength than the martensite but more excellent in toughness than the martensite.

Concretely, the Fe-based sintered alloy of the present invention is characterized in that the total composition consists of, in percentage by mass, Mn: 0.5 to 2.0, Mo: 0.3 to 1.6, Cu: 0.4 to 1.5, C: 0.4 to 0.7 and the balance of Fe plus unavoidable impurities and by having a metallic structure made of 5 to 70% of martensite phase relative to the base material of the sintered alloy except pore and 25 to 90% of bainite phase relative to the base material of the sintered alloy except pore.

The gist of the manufacturing method of the Fe-based sintered alloy according to the present invention is that molybdenum and manganese are used as main raw powder material in the forms of Fe—Mo alloy powder and Fe—Mn alloy powder, and copper powder or copper alloy powder and graphite powder are added to prepare the intended raw powder material.

Here, the wording "main raw powder material" is the same meaning as a main raw powder material normally used and indicates the powder material used at the largest quantity among powder materials.

Concretely, the manufacturing method of Fe-based sintered alloy according to the present invention includes: a raw powder material mixing step of mixing Fe—Mo alloy powder essentially consisting of Mo and the balance of Fe plus unavoidable impurities, Fe—Mn alloy powder essentially consisting of Mn and the balance of Fe plus unavoidable impurities, at least one selected from the group consisting of copper powder, Cu—Mn alloy powder having a liquidus-line temperature of 1120° C. or less and Fe—Cu—Mn alloy powder having a liquidus-line temperature of 1120° C. or less, and graphite powder to blend a raw powder material, in percentage by mass; essentially consisting of, Mn: as to 2.0, Mo: 0.3 to 1.6, Cu: 0.4 to 1.5, C: 0.4 to 0.7 and the balance of Fe plus unavoidable impurities; a compacting step of compressing and compacting the raw powder material obtained in the raw powder material mixing step in a die; and a sintering step of sintering a green compact obtained in the compacting step within a temperature range of 1120 to 1200° C. under non-oxidation atmosphere and then cooling the thus obtained sintered body up to a temperature range of 900 to 200° C. at an average cooling rate within a range of 10 to 60° C./minute.

The Fe-based sintered alloy of the present invention has both of high mechanical strength and toughness by adjusting the metallic structure thereof and is preferable for a synchronizer hub and the like subject to repeated impact.

According to the manufacturing method of the Fe-based sintered alloy, the raw powder material does not contain nickel which is expensive and the aforementioned metallic structure can be obtained by means of sintering process without quenching process, thereby forming the Fe-based sintered alloy in low cost and manufacturing the aforementioned mechanical component.

MODE FOR CARRYING OUT THE INVENTION

In the sintered alloy of the present invention, molybdenum and manganese are employed as alloy element for the improvement of quenching in substitution for nickel. The molybdenum and manganese affect critical cooling rate largely as compared with the nickel so that a small amount of addition thereof can enhance the quenching of the iron base material of the sintered alloy. These alloy elements form the respective special carbides so as to suppress the growth of crystal grain and thus contribute to the enhancement of the mechanical strength of the iron base material. With respect to the manganese and the molybdenum, if the content of the manganese is set within a range of less than 0.5 mass % and the content of the molybdenum is set within a range of less than 0.3 mass %, the improvement in quenching becomes poor. On the other hand, if the content of the manganese is set within a range of more than 2.0 mass % and the content of the molybdenum is set within a range of more than 1.6 mass %, the quenching is too enhanced so that the ratio of the martensite phase, which will be described hereinafter, becomes excess and thus the toughness of the sintered alloy is deteriorated.

In the sintered alloy of the present invention, the metallic structure is a mixed structure made of martensite phase which is excellent in mechanical strength and poor in toughness and bainite phase which is poorer in mechanical strength than martensite and more excellent in toughness than martensite. Then, 5 to 70% relative to the total area of the base material except pore is the martensite while 25 to 90% relative to the total area of the base material except pore is the bainite phase when the metallic structure in the cross section of the sintered alloy is observed. If the ratio of the martensite phase is set within a range of less than 5%, the mechanical strength of the sintered alloy becomes poor. On the other hand, if the ratio of the martensite phase is set within a range of more than 70%, the toughness of the sintered alloy becomes poor. If the ratio of the bainite phase is set within a range of more than 90%, the mechanical strength of the sintered alloy becomes poor.

In the sintered alloy of the present invention, it is preferable that the sintered alloy is made only of the mixed structure of the martensite phase and the bainite phase, but only if 90% or more of the mixed phase occupies the total area of the sintered alloy, the remnant phase of 10% or less may be a mixed, phase of pearlite, sorbite, ferrite and the like.

Since the diffusion velocity of the molybdenum into the iron base material is very slow, the molybdenum is added in the form of Fe—Mo alloy powder as main raw powder material. On the other hand, since the manganese affects the hardness of the iron base material largely, the compressibility of the raw powder material is deteriorated if the manganese is added in the form of the main raw powder material with which the manganese is alloyed. Therefore, the manganese is added in the form of Fe—Mn alloy powder with the Fe—Mo alloy powder. The manganese which is added in the form, of Fe—Mo alloy powder is diffused into the Fe—Mo alloy powder as the main raw powder material at sintering to form the iron base material of the sintered alloy.

In the case that the Fe—Mo alloy powder is added to the Fe—Mo alloy powder, however, the diffusion velocity of the manganese becomes slow so that excess period of time is required for the sintering of the raw powder material. In this point of view, in the present invention, copper is employed and added in the form of copper powder or copper alloy powder. In this case, copper liquid phase is generated during the sintering of the raw powder material, thereby promoting the sintering and the diffusion of the manganese into the iron base material. Moreover, since the copper also enhances the critical cooling rate and thus contributes to the improvement in quenching for the iron base material. If the content of the copper is set within a range of less than 0.4%, the amount of the liquid phase to be generated during the sintering becomes poor so that the sintering promotion and manganese diffusion promotion may be deteriorated. On the other hand, if the content of the copper is set within a range of more than 1.5%, the improvement in quenching is too enhanced so that excess martensite phase may be formed.

The copper may be added in the form of the copper alloy powder. However, since the liquid phase is required to be generated, when the copper is added in the form of the copper alloy powder, the copper alloy powder having the lower liquidus-line temperature than the sintering maintenance temperature (as will described hereinafter, 1120° C. or less) must be employed.

Carbon is solid-solved into the iron base material, thereby contributing to the formation of the martensite phase and the bainite phase. If the carbon is added in the form of alloy powder, the compressibility of the raw powder material is deteriorated so that the carbon is added in the form of graphite powder as conventionally conducted. If the content of the carbon is set within a range of less than 0.1%, the aforementioned metallic structure cannot be formed. If the content of the carbon is set within a range of more than 0.8%, the martensite phase becomes too hard so as to rather deteriorate the mechanical strength of the sintered alloy.

In the sintered alloy which is obtained from the raw powder material made by adding the Fe Mn alloy powder, the copper powder or the copper alloy powder and the graphite powder to the Fe—Mo alloy powder as the main raw powder material, the amount of the manganese is increased around the inherent Fe—Mn alloy powder while the amount of the manganese is decreased around the center area of the inherent Fe—Mo alloy powder and the poor area of the inherent Fe—Mn alloy powder. Therefore, the concentration difference of the diffusion amount of the manganese may be formed. The aforementioned metallic structure is formed by the concentration difference of the diffusion amount of the manganese. Namely, the large amount area in diffusion of the manganese forms the martensite phase while the small amount area in diffusion in the manganese forms, the bainite phase.

When the cross section of the sintered alloy is analyzed in metallic structure by means of EPMA apparatus, if the ratio of the area, where the content of the manganese becomes 20% or less, is set within a range of 80% or more at the cross section area ratio, the aforementioned mixed metallic structure can be formed at the aforementioned mixed ratio.

With respect the Fe—Mn alloy powder, if the content of the manganese is decreased, a large amount of the Fe—Mn alloy powder is required to be added so that the aforementioned concentration difference of the diffusion amount of the manganese is unlikely to be formed. On the other hand, if the content of the manganese is too increased, the amount of the manganese to be diffused into the Fe—Mo alloy material is decreased and the compressibility of the Fe—Mn alloy powder is deteriorated so that the compressibility of the raw powder material is deteriorated. In this point of view, the content of the manganese of the Fe—Mn alloy powder is preferably set within a range of 35 to 90 mass %.

Here, it is desired that the manganese does not remain in the form of the Fe—Mn alloy powder, but is diffused into the Fe—Mo alloy material. In this point of view, it is desired that the Fe—Mn alloy powder having an average diameter of 45 μm or less is employed. The area having rich Mn and poor Mo may be formed. The Fe—Mn alloy powder can be obtained by sieving a prescribed Fe—Mn alloy powder with a sieve with 325 mesh and collecting the sieved alloy powder.

With regard to the promotion of the diffusion of the manganese and the suppression of the segregation of the manganese, a conventional segregation prevention treatment may be conducted for the raw powder material. Namely, it is desired that the raw powder material made of the Fe—Mn alloy powder having the average diameter of 45 μm or less and the Fe—Mo alloy powder to which the Fe—Mn alloy powder is adhered or bonded at 50 mass % or more is employed.

As is conducted from the past, the raw powder material is filled into the cavity formed by a die assembly with a die hole forming the outer shape of a component, a lower punch forming the lower end shape of the component, and compressed by an upper punch forming the upper end shape and the lower punch to form a green compact in the shape of the component (compacting process).

The green compact is introduced in a sintering furnace, and kept and sintered within a temperature range of 1120 to 1200° C. under non-oxidation atmosphere. If the sintering temperature is set within a range of less than 1120° C., the inter-diffusion between the raw powder materials is not sufficiently proceeded so as to deteriorate the mechanical strength of the sintered alloy. On the other hand, if the sintering temperature is set within a range of more than 1200° C., the diffusion of the manganese is too proceeded, resulting in the difficulty in the formation of the aforementioned metallic structure while the excess liquid phase is too generated so as to cause the losing shape of the sintered alloy. For example, the keeping time at the sintering temperature may be set within a range of 10 to 180 minutes.

The sintered body which is kept and sintered at the aforementioned temperature range is cooled down within a temperature range below the sintering temperature by 100° C. or more, e.g., up to room temperature and pulled out of the sintered furnace. In this cooling process after the sintering process, by setting the average cooling rate up to a temperature range of 900 to 200° C. within a range of 10 to 60° C./minute, the sintered alloy having the aforementioned metallic structure can be obtained. If the average cooling rate up to the temperature range of 900 to 200° C. is set within a range of more than 60° C./minute, too much martensite may be formed. On the other hand, the average cooling rate is set within a range of less than 10° C./minute, too poor martensite may be formed.

The sintered alloy obtained through the sintering process has the aforementioned metallic structure and thus may be employed as it is. It is desired, however, that annealing process where the sintered body is heated again within a temperature range of 150 to 300° C. and cooled down in the sintering furnace may be conducted for the sintered body because the martensite phase is sensitive similar to the one immediately after quenching. The annealing process may be conducted as follows. Namely, the sintered body is cooled down within a temperature range of 100° C. or less in the cooling process after the sintering process and heated again a temperature range of 150 to 300° C. or kept within a temperature range of 150 to 300° C. in the furnace in the cooling process. The keeping time may be set within a range of 10 to 180 minutes.

In the sintered alloy of the present invention, it is preferable that 0.5 mass % or less of silicon (Si) may be added. The silicon can enhance the critical cooling rate and thus quenching property. Namely, the silicon contributes to the enhancement of the quenching property of the sintered Since the silicon is fast in the diffusion velocity into the iron base material, if the silicon is alloyed with the Fe—Mn alloy powder to form the Fe—Mn—Si alloy powder, the manganese is likely to be diffused into the Fe—Mo alloy with the diffusion of the silicon. However, if the content of the silicon is set within a range of more than 0.5 mass, the improvement in quenching is too enhanced so that excess martensite may be formed. In this manner, the amount of the silicon should be set within a range of 0.5 mass % or less.

When the silicon is solid-solved in the iron base material, the hardness of the iron base material is developed. Therefore, when the silicon is added in the form of the Fe—Mn—Si alloy powder, if the content of the silicon in the Fe—Mn—Si alloy powder is set within a range of more than 30 mass %, the hardness of the Fe—Mn—Si alloy powder is increased so as to deteriorate, the compressibility thereof. In this manner, it is preferable that the content of the silicon in the Fe—Mn—Si alloy powder is set within a range of 30 mass % or less.

EXAMPLES

Example 1

Fe—Mo alloy powder having an average diameter ($D_{50}$) of 88 μm under a sieve with 100 mesh and consisting of, in percentage by mass, Mo: 0.55 and the balance of Fe plus unavoidable impurities, Fe—Mn alloy powder having an average diameter ($D_{50}$) of 16 μm under a sieve with 200 mesh and consisting of, in percentage by mass, Mn: 60 and the balance of Fe plus unavoidable impurities, Fe—Mn (Fe—Mn—Si) alloy powder having an average diameter ($D_{50}$) of 21 μm under a sieve with 200 mesh and consisting of, in percentage by mass, Mn: 60, Si: 16.5 and the balance of Fe plus unavoidable impurities, copper powder under a sieve with 200 mesh, and graphite powder under a sieve with 325 mesh were prepared.

Then, 1 mass % of the copper powder and 0.6 mass % of the graphite powder were added to the Fe—Mo alloy powder while the ratio of the Fe—Mn alloy powder was changed as shown in Table 1 to blend the raw powder materials. The raw powder materials were compressed at a compressing pressure of 600 MPa in the shape of square pillar with a length of 10 mm, a width of 60 mm and a height of 10 mm, and then sintered at a temperature of 1160° C. under a mixed gas atmosphere of nitrogen and hydrogen, and then cooled down within a temperature range of 900 to 200° C. at an average cooling rate of 30° C./minute to form sintered samples indicated by numbers of 01 to 22. The composition in each of the sintered samples was listed in Table 2.

The square pillar shaped samples were mechanically machined in the form of tension test so as to measure the respective tensile strengths. Then, some of the square pillar shaped samples were supplied for unnotched Charpy impact test and thus measured in the respective unnotched Charpy impact values. The cross sections of the sintered samples were observed by a microscope of 500 magnifications and analyzed in image by an image processor (WinROOF, made by MITANI CORPORATION) so as to measure the ratio of the martensite phase and the bainite phase relative to the total area of the base material except pore. The measured results were listed in Table 3. In Table 3, the martensite phase is indicated as "Mt Phase" and the bainite phase is indicated as "B phase". Note that the sintered samples having the tensile strength of 700 MPa or more and Charpy impact value of 17 J/cm$^2$ or more pass the aforementioned tests.

TABLE 1

| SAMPLE No. | MIXING RATIO, MASS % | | | | | | |
|---|---|---|---|---|---|---|---|
| | Fe—Mo ALLOY POWDER | Fe—Mn ALLOY POWDER | | | | COPPER POWDER | GRAPHITE POWDER |
| | | | COMPOSITION, MASS % | | | | |
| | | | Fe | Mn | Si | | |
| 01 | BALANCE | 0.00 | BALANCE | 60.00 | — | 1.00 | 0.60 |
| 02 | BALANCE | 0.41 | BALANCE | 60.00 | — | 1.00 | 0.60 |
| 03 | BALANCE | 0.83 | BALANCE | 60.00 | — | 1.00 | 0.60 |
| 04 | BALANCE | 1.25 | BALANCE | 60.00 | — | 1.00 | 0.60 |
| 05 | BALANCE | 1.66 | BALANCE | 60.00 | — | 1.00 | 0.60 |
| 06 | BALANCE | 2.00 | BALANCE | 60.00 | — | 1.00 | 0.60 |
| 07 | BALANCE | 2.17 | BALANCE | 60.00 | — | 1.00 | 0.60 |
| 08 | BALANCE | 2.50 | BALANCE | 60.00 | — | 1.00 | 0.60 |
| 09 | BALANCE | 3.00 | BALANCE | 60.00 | — | 1.00 | 0.60 |
| 10 | BALANCE | 3.33 | BALANCE | 60.00 | — | 1.00 | 0.60 |
| 11 | BALANCE | 4.16 | BALANCE | 60.00 | — | 1.00 | 0.60 |
| 12 | BALANCE | 0.00 | BALANCE | 60.00 | 16.50 | 1.00 | 0.60 |
| 13 | BALANCE | 0.41 | BALANCE | 60.00 | 16.50 | 1.00 | 0.60 |
| 14 | BALANCE | 0.83 | BALANCE | 60.00 | 16.50 | 1.00 | 0.60 |
| 15 | BALANCE | 1.25 | BALANCE | 60.00 | 16.50 | 1.00 | 0.60 |
| 16 | BALANCE | 1.66 | BALANCE | 60.00 | 16.50 | 1.00 | 0.60 |
| 17 | BALANCE | 2.00 | BALANCE | 60.00 | 16.50 | 1.00 | 0.60 |
| 18 | BALANCE | 2.17 | BALANCE | 60.00 | 16.50 | 1.00 | 0.60 |
| 19 | BALANCE | 2.50 | BALANCE | 60.00 | 16.50 | 1.00 | 0.60 |
| 20 | BALANCE | 3.00 | BALANCE | 60.00 | 16.50 | 1.00 | 0.60 |
| 21 | BALANCE | 3.33 | BALANCE | 60.00 | 16.50 | 1.00 | 0.60 |
| 22 | BALANCE | 4.16 | BALANCE | 60.00 | 16.50 | 1.00 | 0.60 |

TABLE 2

| SAMPLE No. | COMPOSITION, MASS % | | | | | |
|---|---|---|---|---|---|---|
| | Fe | Mn | Mo | Si | Cu | C |
| 01 | BALANCE | 0.00 | 0.54 | — | 1.00 | 0.55 |
| 02 | BALANCE | 0.25 | 0.54 | — | 1.00 | 0.55 |
| 03 | BALANCE | 0.50 | 0.54 | — | 1.00 | 0.55 |
| 04 | BALANCE | 0.75 | 0.53 | — | 1.00 | 0.55 |
| 05 | BALANCE | 1.00 | 0.53 | — | 1.00 | 0.55 |
| 06 | BALANCE | 1.20 | 0.53 | — | 1.00 | 0.55 |
| 07 | BALANCE | 1.30 | 0.53 | — | 1.00 | 0.55 |
| 08 | BALANCE | 1.50 | 0.53 | — | 1.00 | 0.55 |
| 09 | BALANCE | 1.80 | 0.52 | — | 1.00 | 0.55 |
| 10 | BALANCE | 2.00 | 0.52 | — | 1.00 | 0.55 |
| 11 | BALANCE | 2.50 | 0.52 | — | 1.00 | 0.55 |
| 12 | BALANCE | 0.00 | 0.54 | 16.50 | 1.00 | 0.55 |

TABLE 2-continued

| SAMPLE No. | COMPOSITION, MASS % | | | | | |
|---|---|---|---|---|---|---|
| | Fe | Mn | Mo | Si | Cu | C |
| 13 | BALANCE | 0.25 | 0.54 | 16.50 | 1.00 | 0.55 |
| 14 | BALANCE | 0.50 | 0.54 | 16.50 | 1.00 | 0.55 |
| 15 | BALANCE | 0.75 | 0.53 | 16.50 | 1.00 | 0.55 |
| 16 | BALANCE | 1.00 | 0.53 | 16.50 | 1.00 | 0.55 |
| 17 | BALANCE | 1.20 | 0.53 | 16.50 | 1.00 | 0.55 |
| 18 | BALANCE | 1.30 | 0.53 | 16.50 | 1.00 | 0.55 |
| 19 | BALANCE | 1.50 | 0.53 | 16.50 | 1.00 | 0.55 |
| 20 | BALANCE | 1.80 | 0.52 | 16.50 | 1.00 | 0.55 |
| 21 | BALANCE | 2.00 | 0.52 | 16.50 | 1.00 | 0.55 |
| 22 | BALANCE | 2.50 | 0.52 | 16.50 | 1.00 | 0.55 |

TABLE 3

| SAMPLE No. | AREA RATIO RELATIVE TO BASE MATERIAL | | | TENSILE STRENGTH MPa | IMPACT VALUE J/cm$^2$ | NOTE |
|---|---|---|---|---|---|---|
| | Mt PHASE | B PHASE | OTHERS | | | |
| 01 | 1.6 | 97.7 | 0.7 | 582 | 18.0 | CONTENT OF Mn LESS THAN LOWER LIMITED VALUE |
| 02 | 3.8 | 95.1 | 1.1 | 644 | 20.1 | CONTENT OF Mn LESS THAN LOWER LIMITED VALUE |
| 03 | 5.8 | 90.0 | 4.2 | 700 | 21.2 | CONTENT OF Mn EQUAL TO LOWER LIMITED VALUE |
| 04 | 14.2 | 81.8 | 4.0 | 716 | 23.2 | |
| 05 | 24.4 | 70.9 | 4.7 | 738 | 24.0 | |
| 06 | 34.0 | 60.8 | 5.2 | 748 | 23.1 | |
| 07 | 38.8 | 55.1 | 6.1 | 767 | 22.4 | |
| 08 | 46.0 | 47.8 | 6.2 | 788 | 22.2 | |
| 09 | 56.4 | 37.2 | 6.4 | 780 | 20.2 | |
| 10 | 60.7 | 32.1 | 7.2 | 756 | 17.8 | CONTENT OF Mn EQUAL TO UPPER LIMITED VALUE |
| 11 | 68.0 | 24.5 | 7.5 | 678 | 14.1 | CONTENT OF Mn MORE THAN UPPER LIMITED VALUE |
| 12 | 2.2 | 97.0 | 0.8 | 601 | 16.9 | CONTENT OF Mn LESS THAN LOWER LIMITED VALUE |

TABLE 3-continued

| SAMPLE No. | AREA RATIO RELATIVE TO BASE MATERIAL Mt PHASE | B PHASE | OTHERS | TENSILE STRENGTH MPa | IMPACT VALUE J/cm$^2$ | NOTE |
|---|---|---|---|---|---|---|
| 13 | 4.7 | 94.3 | 1.0 | 678 | 18.9 | CONTENT OF Mn LESS THAN LOWER LIMITED VALUE |
| 14 | 7.7 | 88.9 | 3.4 | 734 | 20.2 | CONTENT OF Mn EQUAL TO LOWER LIMITED VALUE |
| 15 | 18.4 | 76.7 | 4.9 | 765 | 22.4 | |
| 16 | 34.2 | 61.1 | 4.7 | 799 | 23.7 | |
| 17 | 41.5 | 52.3 | 6.2 | 812 | 23.1 | |
| 18 | 50.0 | 44.3 | 5.7 | 835 | 21.7 | |
| 19 | 57.4 | 36.8 | 5.8 | 856 | 21.0 | |
| 20 | 62.2 | 32.5 | 5.3 | 855 | 19.3 | |
| 21 | 68.8 | 26.0 | 5.2 | 804 | 17.2 | CONTENT OF Mn EQUAL TO UPPER LIMITED VALUE |
| 22 | 73.8 | 21.3 | 4.9 | 723 | 13.3 | CONTENT OF Mn MORE THAN UPPER LIMITED VALUE |

The sample No. 01 to 11 relate to the examples where the Fe—Mn alloy powder not containing Si is employed. According to these samples, it is recognized that the amount of the martensite phase is increased while the amount of the bainite phase is decreased, as the content of the manganese is increased. In this case, the tensile strength is inclined to be increased within a manganese content range of 1.5 to 1.8 mass %. However, since the martensite phase is sensitive similar to the one immediately after quenching and not subject to annealing, the tensile strength is decreased under the condition that the martensite phase is much increased and the bainite phase is much decreased as the content of the manganese is much increased.

From Table 3, it is turned out that the tensile strength of 700 MPa or more and the Charpy impact value of 17 J/cm$^2$ or more can be realized within a manganese content range of 0.5 to 2 mass % (refer to sample No. 03 to 10).

The sample No. 12 to 22 relate to the examples where the Fe—Mn alloy powder containing Si is employed and then exhibit similar trends to the ones of the sample. No. 01 to 11. Namely, it is recognized that the amount of the martensite phase is increased while the amount of the bainite phase is decreased as the content of the manganese is increased. In this case, the tensile strength is inclined to be increased within a manganese content range of 1.5 to 1.8 mass %. However, the tensile strength is decreased under the condition that the martensite phase is much increased and the bainite phase is much decreased as the content of the manganese is much increased. The Charpy impact value is increased within a range of 1 mass % or less as the content of the manganese is increased, but is apt to be decreased as the content of the manganese is much increased beyond 1 mass %. Moreover, in the case that the Fe—Mn alloy powder containing Si is employed, the base material is strengthened so that the tensile strength is enhanced but the Charpy impact value is slightly deteriorated as compared with the case that the Fe—Mn alloy powder not containing Si is employed.

In the case that the Fe—Mn alloy powder containing Si is employed, it is turned out that the tensile strength of 700 MPa or more and the Charpy impact value of 17 J/cm$^2$ or more can be realized within a manganese content range of 0.5 to 2 mass % (refer to sample No. 14 to 21).

Example 2

The Fe—Mo alloy powder (Mo: 0.55 mass %, the copper powder, the graphite powder which are employed in Example 1 and the Fe—Mn (Fe—Mn—Si) alloy powder shown in Table 4 were prepared. Then, these alloy powders were mixed at the ratios shown in Table 4 to blend the respective raw powder materials. The thus obtained raw powder materials were compressed and sintered respectively in the same manner as in Example 1 to form sintered samples 23 to 29. The compositions of the sintered samples were listed in Table 5.

The sintered samples were investigated in the same manner as in Example 1 so as to measure the tensile strengths, Charpy impact values thereof and measure the ratio of the martensite phase and the bainite phase occupying the base material except pore thereof through the analysis of the metallic structures thereof. The measured results were listed in Table 6. In Tables 4 to 6, the results of the sintered samples 07 and 18 obtained in Example 1 were also listed.

TABLE 4

| SAMPLE No. | MIXING RATIO, MASS % Fe—Mo ALLOY POWDER | | Fe—Mn ALLOY POWDER COMPOSITION, MASS % Fe | Mn | Si | COPPER POWDER | GRAPHITE POWDER |
|---|---|---|---|---|---|---|---|
| 07 | BALANCE | 2.17 | BALANCE | 60.00 | — | 1.00 | 0.60 |
| 23 | BALANCE | 2.17 | BALANCE | 60.00 | 5.00 | 1.00 | 0.60 |
| 24 | BALANCE | 2.17 | BALANCE | 60.00 | 10.00 | 1.00 | 0.60 |
| 25 | BALANCE | 2.17 | BALANCE | 60.00 | 15.00 | 1.00 | 0.60 |

TABLE 4-continued

| SAMPLE No. | MIXING RATIO, MASS % Fe—Mo ALLOY POWDER | | Fe—Mn ALLOY POWDER COMPOSITION, MASS % Fe | Mn | Si | COPPER POWDER | GRAPHITE POWDER |
|---|---|---|---|---|---|---|---|
| 18 | BALANCE | 2.17 | BALANCE | 60.00 | 16.50 | 1.00 | 0.60 |
| 26 | BALANCE | 2.17 | BALANCE | 60.00 | 20.00 | 1.00 | 0.60 |
| 27 | BALANCE | 2.17 | BALANCE | 60.00 | 25.00 | 1.00 | 0.60 |
| 28 | BALANCE | 2.17 | BALANCE | 60.00 | 30.00 | 1.00 | 0.60 |
| 29 | BALANCE | 2.17 | BALANCE | 60.00 | 35.00 | 1.00 | 0.60 |

TABLE 5

| SAMPLE No. | COMPOSITION, MASS % Fe | Mn | Mo | Si | Cu | C |
|---|---|---|---|---|---|---|
| 07 | BALANCE | 1.30 | 0.53 | — | 1.00 | 0.55 |
| 23 | BALANCE | 1.30 | 0.53 | 0.11 | 1.00 | 0.55 |
| 24 | BALANCE | 1.30 | 0.53 | 0.22 | 1.00 | 0.55 |
| 25 | BALANCE | 1.30 | 0.53 | 0.33 | 1.00 | 0.55 |
| 18 | BALANCE | 1.30 | 0.53 | 0.36 | 1.00 | 0.55 |
| 26 | BALANCE | 1.30 | 0.53 | 0.43 | 1.00 | 0.55 |
| 27 | BALANCE | 1.30 | 0.53 | 0.54 | 1.00 | 0.55 |
| 28 | BALANCE | 1.30 | 0.53 | 0.65 | 1.00 | 0.55 |
| 29 | BALANCE | 1.30 | 0.53 | 0.76 | 1.00 | 0.55 |

TABLE 6

| SAMPLE No. | AREA RATIO RELATIVE TO BASE MATERIAL Mt PHASE | B PHASE | OTHERS | TENSILE STRENGTH MPa | IMPACT VALUE J/cm$^2$ | NOTE |
|---|---|---|---|---|---|---|
| 07 | 38.8 | 55.1 | 6.1 | 767 | 22.4 | |
| 23 | 41.1 | 52.1 | 6.8 | 788 | 23.1 | |
| 24 | 44.4 | 49.9 | 5.7 | 802 | 22.8 | |
| 25 | 48.2 | 47.0 | 4.8 | 820 | 22.1 | |
| 18 | 50.0 | 44.3 | 5.7 | 835 | 21.7 | |
| 26 | 54.3 | 40.2 | 5.5 | 844 | 21.2 | |
| 27 | 58.9 | 34.5 | 6.6 | 842 | 20.4 | |
| 28 | 63.1 | 28.8 | 8.1 | 822 | 18.6 | CONTENT OF Si EQUAL TO UPPER LIMITED VALUE |
| 29 | 67.7 | 22.2 | 10.1 | 801 | 16.4 | CONTENT OF Si MORE THAN UPPER LIMITED VALUE |

The influence of the silicon in the respective sintered alloys can be recognized from the sample No 07, 18, 23 to 29 when the silicon is added to the sintered alloys. In the sample No. 18, 23 to 29 containing the silicon, the amount of the martensite phase is apt to be increased and the amount of the bainite phase is apt to be decreased as the content of the silicon is increased as compared with the sample No. 07 not containing the silicon. According to this tendency, the tensile strength is increased up to about 0.43 mass % of the silicon. However, since the martensite phase is sensitive similar to the one immediately after quenching and not subject to annealing, the tensile strength is apt to be decreased under the condition that the amount of the martensite phase is increased and the bainite phase is decreased as the content of the silicon is much increased. The Charpy impact value becomes maximum at 0.11 mass % of the silicon and is apt to be decreased as the content of the silicon is increased beyond 0.11 mass %. In this manner, the addition of the silicon enhances the tensile strength but deteriorates the Charpy impact value. It is turned out, therefore, that the content of the silicon is preferably set within a range of 0.5 MASS % or less in order to render the Charpy impact value within a range of 17 J/cm$^2$ or more.

Moreover, in the case that the silicon is contained in the Fe—Mn alloy powder, it is turned out that the content of the silicon in the Fe—Mn alloy powder is set within a range of 30 mass % or less (refer to sample No. 18, 23 to 28).

Example 3

The Fe—Mo alloy powders having the respective compositions as shown in Table 7 were prepared while the copper powder, the graphite powder and Fe—Mn (Fe—Mn—Si) alloy powder, in percentage by mass, consisting of, Mn: 60, Si: 16.5, and the balance of Fe plus unavoidable impurities, which were used in Example 1, were prepared. Then, these alloy powders were mixed at the ratios shown in Table 7 to blend the respective raw powder materials. The thus obtained raw powder materials were compressed and sintered respectively in the same manner as in Example 1 to form sintered samples 30 to 37. The compositions of the sintered samples were listed in Table 8.

The sintered samples were investigated in the same manner as in Example 1 so as to measure the tensile strengths, Charpy impact values thereof and measure the ratio of the martensite phase and the bainite phase occupying the base material except pore thereof through the analysis of the metallic structures thereof. The measured results were listed in Table 9. In Tables 7 to 9, the results of the sintered sample 18 obtained in Example 1 were also listed.

TABLE 7

| SAMPLE No. | MIXING RATIO, MASS % | | | | | |
|---|---|---|---|---|---|---|
| | Fe—Mo ALLOY POWDER | | | Fe—Mn ALLOY POWDER | COPPER POWDER | GRAPHITE POWDER |
| | | COMPOSITION, MASS % | | | | |
| | | Fe | Mo | | | |
| 30 | BALANCE | BALANCE | — | 2.17 | 1.00 | 0.60 |
| 31 | BALANCE | BALANCE | 0.31 | 2.17 | 1.00 | 0.60 |
| 18 | BALANCE | BALANCE | 0.55 | 2.17 | 1.00 | 0.60 |
| 32 | BALANCE | BALANCE | 0.80 | 2.17 | 1.00 | 0.60 |
| 33 | BALANCE | BALANCE | 1.00 | 2.17 | 1.00 | 0.60 |
| 34 | BALANCE | BALANCE | 1.20 | 2.17 | 1.00 | 0.60 |
| 35 | BALANCE | BALANCE | 1.40 | 2.17 | 1.00 | 0.60 |
| 36 | BALANCE | BALANCE | 1.66 | 2.17 | 1.00 | 0.60 |
| 37 | BALANCE | BALANCE | 2.00 | 2.17 | 1.00 | 0.60 |

TABLE 8

| SAMPLE No. | COMPOSITION, MASS % | | | | | |
|---|---|---|---|---|---|---|
| | Fe | Mn | Mo | Si | Cu | C |
| 30 | BALANCE | 1.30 | — | 0.36 | 1.00 | 0.55 |
| 31 | BALANCE | 1.30 | 0.30 | 0.36 | 1.00 | 0.55 |
| 18 | BALANCE | 1.30 | 0.53 | 0.36 | 1.00 | 0.55 |
| 32 | BALANCE | 1.30 | 0.77 | 0.36 | 1.00 | 0.55 |
| 33 | BALANCE | 1.30 | 0.96 | 0.36 | 1.00 | 0.55 |
| 34 | BALANCE | 1.30 | 1.16 | 0.36 | 1.00 | 0.55 |
| 35 | BALANCE | 1.30 | 1.35 | 0.36 | 1.00 | 0.55 |
| 36 | BALANCE | 1.30 | 1.60 | 0.36 | 1.00 | 0.55 |
| 37 | BALANCE | 1.30 | 1.93 | 0.36 | 1.00 | 0.55 |

TABLE 9

| SAMPLE No. | AREA RATIO RELATIVE TO BASE MATERIAL | | | TENSILE STRENGTH MPa | IMPACT VALUE J/cm$^2$ | NOTE |
|---|---|---|---|---|---|---|
| | Mt PHASE | B PHASE | OTHERS | | | |
| 30 | 2.7 | 56.0 | 41.3 | 425 | 28.1 | CONTENT OF Mo LESS THAN LOWER LIMITED VALUE |
| 31 | 34.6 | 55.5 | 9.9 | 700 | 25.3 | CONTENT OF Mo EQUAL TO LOWER LIMITED VALUE |
| 18 | 50.0 | 44.3 | 5.7 | 835 | 21.7 | |
| 32 | 56.7 | 39.2 | 4.1 | 867 | 19.4 | |
| 33 | 62.8 | 34.0 | 3.2 | 902 | 18.8 | |
| 34 | 65.0 | 32.4 | 2.6 | 935 | 18.2 | |
| 35 | 68.6 | 27.6 | 3.8 | 974 | 17.6 | |
| 36 | 70.0 | 25.0 | 5.0 | 952 | 17.0 | CONTENT OF Mo EQUAL TO UPPER LIMITED VALUE |
| 37 | 75.6 | 18.6 | 5.8 | 823 | 14.8 | CONTENT OF Mo MORE THAN UPPER LIMITED VALUE |

The influence of the molybdenum in the respective sintered alloys can be recognized from the sample No, 18, 30 to 37 when the molybdenum is added to the sintered alloys. In the sample No. 18, 31 to 37 containing the molybdenum, the amount of the martensite is apt to be increased and the amount of the bainite phase is apt to be decreased as the content of the molybdenum is increased as compared with the sample No. 30 not containing the molybdenum. According to this tendency, the tensile strength is increased up to about 1.35 mass % of the molybdenum. However, since the amount of the martensite phase is increased and the amount of the bainite phase is decreased as the content of the molybdenum is much increased, the tensile strength is apt to be decreased. Moreover, the Charpy impact value is apt to be decreased as the content of the molybdenum is increased. When the content of the molybdenum is beyond 1.6 mass %, the Charpy impact value is decreased within a range of 17 J/cm$^2$ or less.

It is turned out, therefore, that the content of the molybdenum is preferably set within a range of 1.6 mass % or less in order to render the Charpy impact value within a range of 17 j/cm$^2$ or more (refer to sample No. 18, 31 to 36).

Example 4

The Fe—Mo alloy powder, the copper powder, the graphite powder and the Fe—Mn (Fe—Mn—Si) alloy powder, in percentage by mass, consisting of, Mn: 60, Si: 16.5 and the balance of Fe plus unavoidable impurities, which were used in Example 1, were prepared. Then, these alloy powders were mixed at the respective different copper ratios as shown in Table 10 to blend the respective raw powder materials. The thus obtained raw powder materials were compressed and sintered respectively in the same manner as in Example 1 to form sintered samples 38 to 45. The compositions of the sintered samples were listed in Table 11.

The sintered samples were investigated in the same manner as in Example 1 so as to measure the tensile strengths, Charpy impact values thereof and measure the ratio of the martensite phase and the bainite phase occupying the base material except pore thereof through the analysis of the metallic structures thereof. The measured results were listed in Table 12. In Tables 10 to 12, the results of the sintered sample 18 obtained in Example 1 were also listed.

TABLE 10

| SAMPLE No. | MIXING RATIO, MASS % Fe—Mo ALLOY POWDER | Fe—Mn ALLOY POWDER | COPPER POWDER | GRAPHITE POWDER |
|---|---|---|---|---|
| 38 | BALANCE | 2.17 | — | 0.60 |
| 39 | BALANCE | 2.17 | 0.20 | 0.60 |
| 40 | BALANCE | 2.17 | 0.40 | 0.60 |
| 41 | BALANCE | 2.17 | 0.60 | 0.60 |
| 42 | BALANCE | 2.17 | 0.80 | 0.60 |
| 18 | BALANCE | 2.17 | 1.00 | 0.60 |
| 43 | BALANCE | 2.17 | 1.25 | 0.60 |
| 44 | BALANCE | 2.17 | 1.50 | 0.60 |
| 45 | BALANCE | 2.17 | 1.75 | 0.60 |

TABLE 11

| SAMPLE No. | COMPOSITION, MASS % Fe | Mn | Mo | Si | Cu | C |
|---|---|---|---|---|---|---|
| 38 | BALANCE | 1.30 | 0.54 | 0.36 | — | 0.55 |
| 39 | BALANCE | 1.30 | 0.53 | 0.36 | 0.20 | 0.55 |
| 40 | BALANCE | 1.30 | 0.53 | 0.36 | 0.40 | 0.55 |
| 41 | BALANCE | 1.30 | 0.53 | 0.36 | 0.60 | 0.55 |
| 42 | BALANCE | 1.30 | 0.53 | 0.36 | 0.80 | 0.55 |
| 18 | BALANCE | 1.30 | 0.53 | 0.36 | 1.00 | 0.55 |
| 43 | BALANCE | 1.30 | 0.53 | 0.36 | 1.25 | 0.55 |
| 44 | BALANCE | 1.30 | 0.53 | 0.36 | 1.50 | 0.55 |
| 45 | BALANCE | 1.30 | 0.53 | 0.36 | 1.75 | 0.55 |

TABLE 12

| SAMPLE No. | AREA RATIO RELATIVE TO BASE MATERIAL Mt PHASE | B PHASE | OTHERS | TENSILE STRENGTH MPa | IMPACT VALUE J/cm$^2$ | NOTE |
|---|---|---|---|---|---|---|
| 38 | 0.8 | 94.0 | 5.2 | 620 | 13.6 | CONTENT OF Cu LESS THAN LOWER LIMITED VALUE |
| 39 | 3.0 | 91.1 | 5.9 | 689 | 15.9 | CONTENT OF Cu LESS THAN LOWER LIMITED VALUE |
| 40 | 5.0 | 90.0 | 5.0 | 744 | 17.2 | CONTENT OF Cu EQUAL TO LOWER LIMITED VALUE |
| 41 | 22.1 | 69.7 | 8.2 | 794 | 19.9 | |
| 42 | 36.1 | 58.8 | 5.1 | 812 | 21.0 | |
| 18 | 50.0 | 44.3 | 5.7 | 835 | 21.7 | |
| 43 | 58.9 | 34.1 | 7.0 | 836 | 20.7 | |
| 44 | 70.0 | 25.0 | 5.0 | 842 | 19.5 | CONTENT OF Cu EQUAL TO UPPER LIMITED VALUE |
| 45 | 83.2 | 16.5 | 0.3 | 849 | 15.5 | CONTENT OF Cu MORE THAN UPPER LIMITED VALUE |

The influence of the copper in the respective sintered alloys can be recognized from the sample No. 18, 38 to 45 when the copper is added to the sintered alloys. In the sample No. 38 not containing the copper, since the copper liquid phase is not generated during the corresponding sintering process, the sintering process is not sufficiently proceeded and the diffusion of the Fe—Mo alloy powder is also sufficiently proceeded. Moreover, since the amount of the martensite is poor, the tensile strength and the Charpy impact value are decreased. In the sample No. 18, 39 to 45 containing the copper, the amount of the copper liquid phase is increased as the content of the copper is increased to increase the density of the corresponding sintered alloy. Moreover, since the diffusion of the Fe-Ma alloy powder is proceeded as the copper liquid phase is increased, the amount of the martensite phase is increased and the amount of the bainite phase is decreased while the corresponding tensile strength is increased as the content of the copper is increased. However, it is required that the content of the copper is set within a range of 0.4 mass % or more in order to render the tensile strength within a range of 700 MPa·s or more.

The Charpy impact value is increased up to about 1 mass % of the content of the copper with the increase of the content of the copper, but apt to be decreased beyond 1 mass % of the content of the copper. It is required that the content of the copper is set within a range of 0.4 to 1.5 mass % in order to render the Charpy impact value within a range of 17 J/cm$^2$. In this manner, when the copper is added in the corresponding sintered alloy, the tensile strength and Charpy impact value are enhanced, but it is required that the content of the copper is set within a range of 0.4 to 1.5 mass % in order that the tensile strength is set within a range of 700 MPa or more and the Charpy impact value is set within a range of 17 J/cm$^2$ or more (refer to sample No. 18, 40 to 44).

Example 5

The Fe—Mo alloy powder, the copper powder, the graphite powder and the Fe—Mn (Fe—Mn—Si) alloy powder, in percentage by mass, consisting of, Mn: 60, Si; 16.5 and the balance of Fe plus unavoidable impurities, which were used in Example 1, were prepared. Then, these alloy powders were mixed at the respective different graphite powder ratios as shown in Table 13 to blend the respective raw powder materials. The thus obtained raw powder materials were compressed and sintered respectively in the same manner as in Example 1 to form sintered samples 46 to 51. The compositions of the sintered samples were listed in Table 14.

The sintered samples were investigated in the same manner as in Example 1 so as to measure the tensile strengths, Charpy impact values thereof and measure the ratio of the martensite phase and the bainite phase occupying the base material except pore thereof through the analysis of the metallic structures thereof. The measured results were listed in Table 15. In Tables 13 to 15, the results of the sintered sample 18 obtained in Example 1 were also listed.

TABLE 13

| SAMPLE No. | MIXING RATIO, MASS % Fe—Mo ALLOY POWDER | Fe—Mn ALLOY POWDER | COPPER POWDER | GRAPHITE POWDER |
|---|---|---|---|---|
| 46 | BALANCE | 2.17 | 1.00 | 0.35 |
| 47 | BALANCE | 2.17 | 1.00 | 0.45 |
| 48 | BALANCE | 2.17 | 1.00 | 0.55 |
| 18 | BALANCE | 2.17 | 1.00 | 0.60 |
| 49 | BALANCE | 2.17 | 1.00 | 0.65 |
| 50 | BALANCE | 2.17 | 1.00 | 0.75 |
| 51 | BALANCE | 2.17 | 1.00 | 0.85 |

TABLE 14

| SAMPLE No. | COMPOSITION, MASS % Fe | Mn | Mo | Si | CU | C |
|---|---|---|---|---|---|---|
| 46 | BALANCE | 1.30 | 0.54 | 0.36 | 1.00 | 0.31 |
| 47 | BALANCE | 1.30 | 0.53 | 0.36 | 1.00 | 0.40 |
| 48 | BALANCE | 1.30 | 0.53 | 0.36 | 1.00 | 0.49 |
| 18 | BALANCE | 1.30 | 0.53 | 0.36 | 1.00 | 0.55 |
| 49 | BALANCE | 1.30 | 0.53 | 0.36 | 1.00 | 0.60 |
| 50 | BALANCE | 1.30 | 0.53 | 0.36 | 1.00 | 0.70 |
| 51 | BALANCE | 1.30 | 0.53 | 0.36 | 1.00 | 0.78 |

TABLE 15

| SAMPLE No. | AREA RATIO RELATIVE TO BASE MATERIAL Mt PHASE | B PHASE | OTHERS | TENSILE STRENGTH MPa | IMPACT VALUE J/cm$^2$ | NOTE |
|---|---|---|---|---|---|---|
| 46 | 23.4 | 54.1 | 22.5 | 622 | 29.2 | CONTENT OF C LESS THAN LOWER LIMITED VALUE |
| 47 | 33.1 | 59.4 | 7.5 | 742 | 26.7 | CONTENT OF C EQUAL TO LOWER LIMITED VALUE |
| 48 | 38.6 | 52.3 | 9.1 | 794 | 24.5 | |
| 18 | 50.0 | 44.3 | 5.7 | 835 | 21.7 | |
| 49 | 54.7 | 40.4 | 4.9 | 830 | 20.9 | |
| 50 | 63.1 | 32.4 | 4.5 | 815 | 20.2 | CONTENT OF C EQUAL TO UPPER LIMITED VALUE |
| 51 | 72.2 | 24.3 | 3.5 | 768 | 16.8 | CONTENT OF C MORE THAN UPPER LIMITED VALUE |

The influence of the carbon in the respective sintered alloys can be recognized from the sample No. 18, 46 to 51 when the carbon is added to the sintered alloys. In the sample No. 46 containing less than 0.4 mass % of the carbon, since the carbon so as to strengthen the base material is in short, the tensile strength becomes small, but in the sample No. 47 containing 0.4 mass % of the carbon, since the carbon so as to strengthen the base material is contained sufficiently, the tensile strength is increased beyond 700 MPa. Moreover, the tensile strength is increased up to 0.55 mass % of the carbon, but is apt to be decreased beyond 0.55 mass % as the content of the carbon is increased. On the other hand, the Charpy impact value is apt to be decreased as the content of the carbon is increased. Concretely, when the content of the carbon is set within a range of more than 0.7 mass %, the Charpy impact value is decreased within a range of less than 17 J/cm$^2$.

In this manner, since the tensile strength is increased within a carbon content range of 0.4 mass % or more and the Charpy impact value is decreased up to less than 17 J/cm$^2$ within a carbon content range of more than 0.7 mass %, it is turned out that the content of the carbon is set within a range of 0.4 to 0.7 mass % in order to satisfy both of the tensile strength of 700 MPa or more and the Charpy impact value of 17 J/cm$^2$ or more (refer to sample No. 18, 47 to 50).

Example 6

The same raw powder material as the sample No. 18 in Example 1 was employed, and compressed. Then, the sintering temperature and the average cooling rate within a temperature range of 900 to 200° C. after the corresponding sintering process were changed as shown in Table 16 to form sintered samples 52 to 63. The sintered samples were investigated in the same manner as in Example 1 so as to measure the tensile strengths, Charpy impact values thereof and measure the ratio of the martensite phase and the bainite phase occupying the base material except pore thereof through the analysis of the metallic structures thereof. The measured results were listed in Table 16. In Tables 16, the results of the sintered sample 18 obtained in Example 1 were also listed.

TABLE 16

| SAMPLE No. | SINTERING TEMPERATURE ° C. | COOLING RATE ° C./MINUTE | AREA RATIO RELATIVE TO BASE MATERIAL Mt PHASE | B PHASE | OTHERS | TENSILE STRENGTH MPa | IMPACT VALUE J/cm$^2$ | NOTE |
|---|---|---|---|---|---|---|---|---|
| 52 | 1100 | 30 | 0.0 | 97.0 | 3.00 | 660 | 13.5 | LESS THAN LOWER LIMITED VALUE OF SINTERING TEMPERATURE |
| 53 | 1120 | 30 | 8.9 | 88.2 | 2.90 | 712 | 17.1 | EQUAL TO LOWER LIMITED VALUE OF SINTERING TEMPERATURE |
| 54 | 1130 | 30 | 17.8 | 75.9 | 6.30 | 742 | 18.8 | |
| 55 | 1150 | 30 | 38.9 | 56.8 | 4.30 | 781 | 19.7 | |

TABLE 16-continued

| SAMPLE No. | SINTERING TEMPERATURE ° C. | COOLING RATE ° C./MINUTE | AREA RATIO RELATIVE TO BASE MATERIAL Mt PHASE | B PHASE | OTHERS | TENSILE STRENGTH MPa | IMPACT VALUE J/cm$^2$ | NOTE |
|---|---|---|---|---|---|---|---|---|
| 18 | 1160 | 30 | 50.0 | 44.3 | 5.70 | 835 | 21.7 | |
| 56 | 1200 | 30 | 68.1 | 27.4 | 4.50 | 855 | 22.0 | EQUAL TO UPPER LIMITED VALUE OF SINTERING TEMPERATURE |
| 57 | 1250 | 30 | | | (LOSING SHAPE) | | | MORE THAN UPPER LIMITED VALUE OF SINTERING TEMPERATURE |
| 58 | 1160 | 5 | 6.8 | 91.0 | 2.20 | 624 | 14.1 | MORE THAN UPPER LIMITED VALUE OF COOLING RATE |
| 59 | 1160 | 10 | 17.3 | 80.1 | 2.60 | 711 | 17.6 | EQUAL TO UPPER LIMITED VALUE OF COOLING RATE |
| 60 | 1160 | 20 | 38.4 | 56.7 | 4.90 | 769 | 19.9 | |
| 18 | 1160 | 30 | 50.0 | 44.3 | 5.70 | 835 | 21.7 | |
| 61 | 1160 | 50 | 60.3 | 36.1 | 3.60 | 881 | 20.3 | |
| 62 | 1160 | 60 | 70.0 | 24.3 | 5.70 | 903 | 17.2 | EQUAL TO LOWER LIMITED VALUE OF COOLING RATE |
| 63 | 1160 | 80 | 98.0 | 1.5 | 0.50 | 680 | 14.6 | LESS THAN LOWER LIMITED VALUE OF COOLING RATE |

The influence of the change of the sintering temperature in the respective sintered alloys can be recognized from the sample No. 18, 52 to 57. In the sample No. 52 where the sintering temperature is set within a range of less than 1120° C., since the sintering process is not sufficiently progressed and thus the Fe—Mn alloy powder is not sufficiently diffused so that the martensite phase is in short. Therefore, the tensile strength and the Charpy impact value are decreased. On the other hand, in the sample No. 53 where the sintering temperature is set to 1120° C., since the sintering process is sufficiently progressed to increase the density of the sintered body while the Fe—Mn alloy powder is sufficiently diffused so that the martensite phase becomes sufficient. Therefore, the tensile strength is increased up to 700 MPa or more and the Charpy impact value are increased up to 17 J/cm$^2$ or more.

When the sintering temperature is much increased, the tensile strength and the Charpy impact value are much increased because the sintering process is proceeded. In the sample No. 57 where the sintering temperature is set within a range of more than 1200° C., however, the losing shape of the sintered sample is caused so that the sintering test is stopped. In this manner, it is turned out that the sintering temperature should be set within a range of 1120 to 1200° C.

The influence of the average cooling rate up to the temperature range of 900 to 200° C. in the respective sintered alloys during the cooling process after the sintering process can be recognized from the sample No. 18, 58 to 63. In the sample No. 58 where the average cooling rate is set within a range of less than 10° C./minute, the quenching is not conducted during the cooling process after the sintering process so that the tensile strength and the Charpy impact value are decreased because the martensite phase is not sufficiently formed. On the other hand, in the sample No. 59 where the average cooling rate is set to 10° C./minute, the quenching is sufficiently conducted daring the cooling process after the sintering process so that the tensile strength is increased within a range of 700 MPa or more and the Charpy impact value is increased within a range of 17 J/cm$^2$ or more because the martensite phase is sufficiently formed. Moreover, the quenching is likely to be conducted as the average cooling rate is increased so that the tensile strength is increased with the increase of the martensite phase.

However, the martensite phase is sensitive similar to the one immediately after quenching and not subject to annealing. In the sample No. 63 where the average cooling rate is set within a range of more than 60° C./minute, therefore, since the amount of the sensitive martensite phase becomes excess, the tensile strength is remarkably decreased up to less than 700 MPa. The Charpy impact value is apt to be increased within a range of 30° C./minute or less, but is apt to be decreased within a range of more than 30° C./minute. In the sample No. 63 where the average cooling rate is beyond 60° C./minute, the Charpy impact value is decreased up to less than 17 J/cm$^2$.

In this manner, it is turned out that the average cooling rate up to the temperature range of 900 to 200° C. during the cooling process after the sintering process should be set within a range of 10 to 60° C./minute (refer to sample No. 18, 59 to 62).

In Examples 1 to 6, the samples having the tensile strength of 700 MPa or more and the Charpy impact value of 17 J/cm$^2$ have the martensite phase of 5.0 to 70% and the bainite phase of 25.0 to 90%.

INDUSTRIAL APPLICABILITY

The Fe-based sintered alloy of the present invention has both of high mechanical strength and toughness by adjusting the metallic structure thereof and is preferable for a synchronizer hub and the like subject to repeated impact.

What is claimed is:

1. A method of manufacturing an Fe-based sintered alloy, comprising:

a raw powder material mixing step of mixing Fe—Mo alloy powder consisting essentially of Mo and the balance of Fe plus unavoidable impurities, Fe—Mn—Si alloy powder consisting essentially of Mn, Si and the balance of Fe plus unavoidable impurities, at least one selected from the group consisting of copper powder, Cu—Mn alloy powder having a liquidus-line temperature of 1120° C. or less and Fe—Cu—Mn alloy powder having a liquidus-line temperature of 1120° C. or less, and graphite powder to blend a raw powder material, in percentage by mass, consisting of, Mn: 0.5 to 2.0, Mo: 0.3 to 1.6, Cu: 0.4 to 1.5, C: 0.4 to 0.7, Si: 0.11 to 0.65, and the balance of Fe plus unavoidable impurities;

a compacting step of compressing and compacting the raw powder material obtained in the raw powder material mixing step in a die; and a sintering step of sintering a green compact obtained in the compacting step within a temperature range of 1120 to 1200° C. under non-oxidation atmosphere and then cooling the thus obtained sintered body from the sintering temperature to a temperature of 100° C. or less, the sintered body being cooled from 900° C. to 200° C. at an average cooling rate within a range of 10 to 60° C./minute, wherein a content of Mn of the Fe—Mn—Si alloy powder is set within a range of 60 to 90 mass % thereof, and wherein an average diameter of the Fe—Mn—Si alloy powder is set within a range of 45 μm or less.

2. The method as set forth in claim 1, wherein the Fe—Mn—Si alloy powder contains 30 mass % or less of Si.

3. The method as set forth in claim 1, wherein in the cooling process after the sintering process, the sintered body is heated and kept within a temperature range of 150 to 300° C. after the sintered body is cooled to the temperature of 100° C. or less, or the sintered body is kept within a temperature range of 150 to 300° C. before the sintered body is cooled to the temperature of 100° C. or less.

4. The manufacturing method as set forth in claim 1, wherein copper powder is mixed during the a raw powder material mixing step.

5. The manufacturing method as set forth in claim 1, wherein the Fe-based sintered alloy has a tensile strength of 700 MPa or more, and a Charpy impact value of 17 $J/cm^2$ or more.

6. The manufacturing method as set forth in claim 1, wherein the Fe—Mn—Si alloy powder contains 5.00 mass % or more and 16.50 mass % or less of Si.

* * * * *